US011630474B2

(12) United States Patent
von Arx et al.

(10) Patent No.: US 11,630,474 B2
(45) Date of Patent: Apr. 18, 2023

(54) SYSTEMS AND METHODS FOR A CALIBRATION KNOB

(71) Applicant: Rockwell Automation Switzerland GmbH, Aarau (CH)

(72) Inventors: Rahel von Arx, Villnachern (CH); Fabian Ballat, Klingnau (CH); Markus Bachmann, Wölflinswil (CH); Thomas Strebel Marzano, Birmenstorf (CH)

(73) Assignee: Rockwell Automation Switzerland GmbH, Aarau (CH)

( * ) Notice: Subject to any disclaimer, the term of this patent is extended or adjusted under 35 U.S.C. 154(b) by 0 days.

(21) Appl. No.: 17/485,011

(22) Filed: Sep. 24, 2021

(65) Prior Publication Data

US 2022/0011805 A1 Jan. 13, 2022

Related U.S. Application Data

(62) Division of application No. 16/418,156, filed on May 21, 2019, now Pat. No. 11,157,033.

(51) Int. Cl.

| | |
|---|---|
| ***G05G 1/12*** | (2006.01) |
| ***G05G 1/015*** | (2008.04) |
| ***G05G 1/08*** | (2006.01) |

(52) U.S. Cl.

CPC ..... *G05G 1/12* (2013.01); *G05G 1/015* (2013.01); *G05G 1/087* (2013.01); *G05G 2700/04* (2013.01)

(58) Field of Classification Search

CPC ..... G05G 1/015; G05G 1/12; G05G 1/087; G05G 2700/04

See application file for complete search history.

(56) References Cited

U.S. PATENT DOCUMENTS 2,746,417 A * 5/1956 McCord ..... H01C 10/24 116/DIG. 21

3,982,442 A 9/1976 Shiurila (Continued)

FOREIGN PATENT DOCUMENTS

EP 0366445 A2 5/1990

JP 2007-194884 * 2/2007 ..... H04N 5/225

OTHER PUBLICATIONS

Merriam-Webster, Definition of "Ridge", Feb. 24, 2021, 8 pages.

NASA, Newton's Laws of Motion, May 5, 2015, 2 pages.

Wikipedia, Newton's Laws of Motion, Feb. 14, 2021, 7 pages.

*Primary Examiner* — Vinh Luong

(74) *Attorney, Agent, or Firm* — Quarles & Brady LLP

(57) ABSTRACT

A split calibration knob can include a lower knob with a lower-knob attachment interface and an upper knob with an upper-knob attachment interface configured to be engaged with the lower-knob attachment interface. One of the lower-knob attachment interface and the upper-knob attachment interface can include a tube with a first press-fit feature and a first positioning feature positioned on the tube. The other of the lower-knob attachment interface and the upper-knob attachment interface can include a hub having an outward facing surface, a second press-fit feature configured to be engaged with the first press-fit feature to secure the upper knob to the lower knob, and a second positioning feature configured to be engaged with the first positioning feature to fix an orientation of the upper knob relative to the lower knob, thereby linking rotation of the lower knob to the rotation of the upper knob.

20 Claims, 8 Drawing Sheets

(56) References Cited

U.S. PATENT DOCUMENTS

| | | | | |
|---|---|---|---|---|
| 2007/0165135 | A1* | 7/2007 | Sukenari | G09B 5/02 348/373 |
| 2010/0188756 | A1 | 7/2010 | Maruyama et al. | |
| 2015/0076272 | A1* | 3/2015 | Trudel | A43C 7/00 242/381.4 |
| 2016/0312882 | A1* | 10/2016 | Heo | F16H 61/24 |
| 2017/0198830 | A1 | 7/2017 | Doughty et al. | |
| 2020/0063857 | A1* | 2/2020 | Kim | F16H 59/12 |
| 2020/0346888 | A1 | 11/2020 | Kruse et al. | |

* cited by examiner

SYSTEMS AND METHODS FOR A CALIBRATION KNOB

CROSS-REFERENCES TO RELATED APPLICATIONS

This application is a divisional application of U.S. patent application Ser. No. 16/418,156, filed May 21, 2019, and entitled "CALIBRATION KNOB" which is incorporated herein by reference.

STATEMENT REGARDING FEDERALLY SPONSORED RESEARCH

Not Applicable

BACKGROUND INFORMATION

The subject matter disclosed within relates generally to control knobs. In particular the subject matter relates to control knobs for devices that can be calibrated.

BRIEF DESCRIPTION

In one embodiment, a calibration knob can be configured for an adjustable device. The calibration knob can include a lower knob including a lower-knob attachment interface and an upper knob including an upper-knob attachment interface configured to be engaged with the lower-knob attachment interface. One of the lower-knob attachment interface and the upper-knob attachment interface may be configured as a first attachment interface that can include a tube, a first press-fit feature and a first positioning feature. The first press-fit feature and the first positioning feature can be positioned on the tube. The other one of the lower-knob attachment interface and the upper-knob attachment interface may be configured as a second attachment interface that can include a hub, a hub having an outward facing surface, a second press-fit feature and a second positioning feature. The second press-fit feature can be configured to be engaged with the first press-fit feature to secure the upper knob to the lower knob. The second positioning feature can be configured to be engaged with the first positioning feature to fix an orientation of the upper knob relative to the lower knob. This may link the rotation of the lower knob to the rotation of the upper knob.

In some embodiments, a calibration system may be configured for an adjustable device. The calibration system can include a calibration assembly and a split calibration knob. The calibration assembly can include a lever rotatably received by a base, and the lever can be configured to adjust a device setting of the adjustable device based on a position of the lever. The split calibration knob may be configured to be secured on the adjustable device and can include a lower knob and an upper knob. The lower knob can be configured to be rotatably received by the base and may include a biasing feature configured to adjust the position of the lever when the lower knob is rotated. The upper knob can be configured to be secured to the lower knob in an orientation that is independent of the position of the lower knob.

One embodiment of a method of calibrating an adjustable device with a split calibration knob can include steps for receiving a lower knob on the adjustable device, rotating the lower knob to adjust a device setting of the adjustable device, placing a cover on the adjustable device, and attaching an upper knob to the lower knob in an orientation that corresponds the device setting.

The foregoing and other aspects and advantages of the present disclosure will appear from the following description. In the description, reference is made to the accompanying drawings which form a part hereof, and in which there is shown by way of illustrations one or more embodiments of the present disclosure. Such embodiments do not necessarily represent the full scope of the present disclosure, however, and reference is made therefore to the claims and herein for interpreting the scope of the present disclosure.

BRIEF DESCRIPTION OF DRAWINGS

The present disclosure will be better understood and features, aspects and advantages other than those set forth above will become apparent when consideration is given to the following detailed description thereof. Such detailed description makes reference to the following drawings.

DETAILED DESCRIPTION

Figure 1:
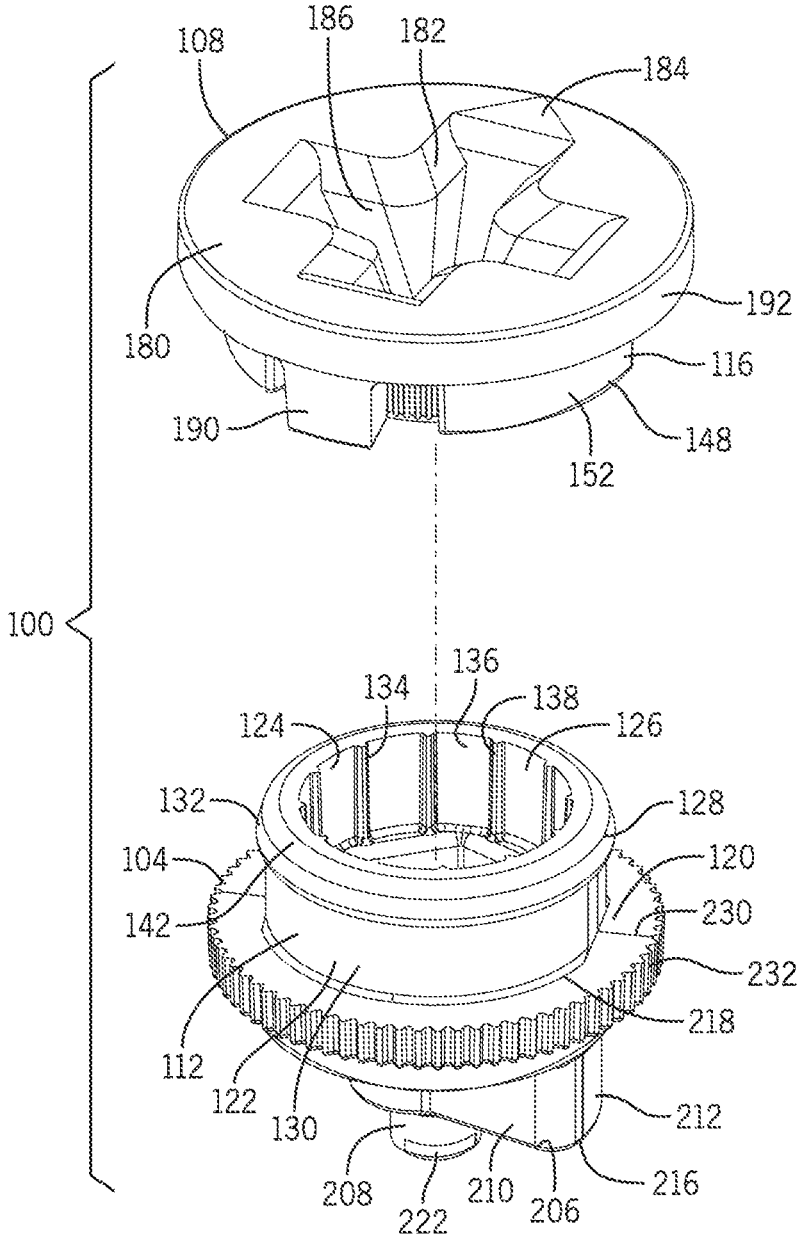
FIG. 1 is an exploded perspective view of a split calibration knob according to some embodiments of the present disclosure.

Before any embodiments of the invention are explained in detail, it is to be understood that the embodiments are not limited in its application to the details of construction and the arrangement of components set forth in the following description or illustrated in the following drawings. Aspects of the present disclosure are capable of other embodiments and of being practiced or of being carried out in various ways. Also, it is to be understood that the use the phraseology and terminology used herein is for the purpose of description and should not be regarded as limiting. Furthermore, the use of "right", "left", "front", "back", "upper", "lower", "above", "below", "top", or "bottom" and variations thereof herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the present disclosure. Various modifications to the illustrated embodiments will be readily apparent to those skilled in the art, and the generic principles herein can be applied to other embodiments and applications without departing from embodiments of the present disclosure. Thus, embodiments of the present disclosure are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the present disclosure. Skilled artisans will recognize the examples provided herein have many useful alternatives and fall within the scope of embodiments of the present disclosure.

Disclosed herein is a split calibration knob which may be used to calibrate an adjustable device so that it may operate using a scale positioned on a cover of the device in a predetermined location. Some embodiments may reduce (or eliminate, in some cases) the need for custom printing, tooling, or device-specific manufacturing processes when calibrating the adjustable device, thereby reducing manufacturing costs and standardizing the appearance of such a device.

Some embodiments of the split knob can include two sections—a lower knob and an upper knob—that may be manually coupled to one other by a lower-knob attachment interface and a complementary upper-knob attachment interface. The lower-knob attachment interface can be configured to engage the upper-knob attachment interface with the upper knob being initially oriented to face substantially any direction relative to the lower knob. Once coupled, rotation of the upper knob relative to the lower knob may be restricted by the engagement of the attachment interfaces, thereby locking the orientation of the upper knob relative to the lower knob. Thus, rotation of the upper and lower knob may be linked such that the lower knob may be rotated by turning the upper knob.

In some situations, embodiments of a split calibration knob are used with an adjustable device. Accordingly, the lower knob may be rotatably received beneath the cover and can include a biasing feature, such as a cam. When the lower knob is rotated, the biasing feature can adjust the position of a lever linked to the adjustable device in order to change a device setting of the adjustable device. Prior to attaching the upper knob, the lower knob can be rotated to a desired initial position or "set point." The upper knob can then be attached to the lower knob such that an orientation indicator on the upper knob points to a position on the predetermined scale of the cover that corresponds to the set point. With the upper knob attached, the device setting can be adjusted by rotating the upper knob so that the orientation indicator points to a position on the predetermined scale corresponding to the desired value of the device setting. Thus, in some embodiments, a split calibration knob can be used to calibrate an adjustable device such that an orientation indicator points to the desired (e.g., proper) position on a predetermined scale, regardless of where the scale is positioned on the cover of the adjustable device.

FIG. 1 is a split calibration knob 100 that is shown to include a lower knob 104 and an upper knob 108, which can be configured to be manually engaged with each other. To this end, a lower-knob attachment interface 112 of the lower knob 104 can be configured to engage an upper-knob attachment interface 116 of the upper knob 108, thereby securing the upper knob 108 to the lower knob 104.

In some embodiments, the lower-knob attachment interface 112 can be configured as a first attachment interface 122 including a tube 124 positioned centrally on a top side 120 of the lower knob 104, and which defines a central cavity 126. An annular lip 128 can project radially outward from an outer surface 130 of the tube 124 and can be configured as a first press-fit feature 132 for joining the upper and lower knobs 104, 108. The tube 124 may also include at least one first positioning feature 134 positioned on an interior surface 136 of the tube 124. In the illustrated embodiment, for example, a plurality of first positioning features 134 are configured as inward facing ridges 138. The inward facing ridges 138 may be evenly spaced around the interior surface 136 and can each extend from the bottom of the tube 124 to an axial end 142 thereof.

It should be appreciated that some embodiments can include at least one of an additional first press-fit feature and an additional first positioning feature, which may be the same or different than those of the illustrated embodiments. For example, an annular lip may only extend around a portion of the outer surface of the tube, and/or an annular lip may be broken into multiple circumferential segments. Additionally or alternatively, an annular lip may be formed on the interior surface of the tube. In some embodiments, a first attachment interface can include more first positioning features or fewer first positioning features than the illustrated embodiment, and at least one first positioning feature can be different than at least one other first positioning feature. For example, at least one first positioning feature may be configured as a plurality of teeth, at least one of which only extends a portion of the way from the bottom of the tube to its axial end. Additionally or alternatively, at least one ridge can be broken into multiple segments, and at least one first positioning feature can be formed on the outer surface of the tube.

Figure 2:
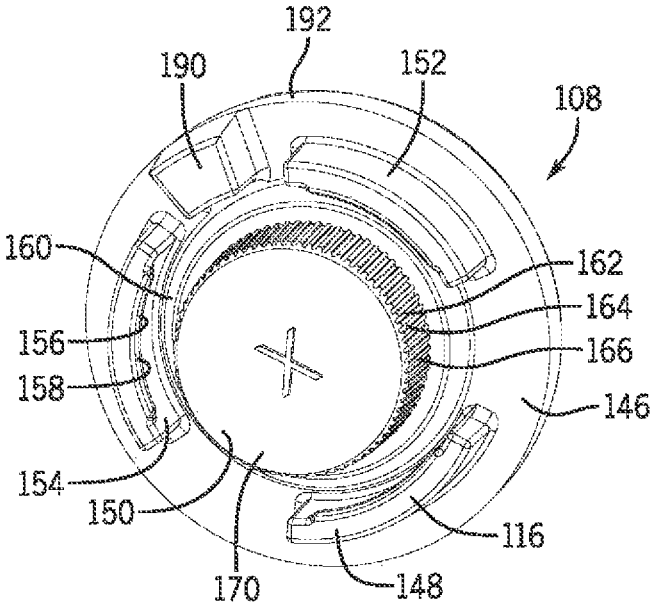
FIG. 2 is a perspective view of an upper knob of FIG. 1.

The upper knob 108 can include an upper-knob attachment interface 116 that is generally complimentary to the configuration to the lower knob attachment interface 112. As illustrated in FIG. 2, for example, the upper-knob attachment interface 116 can be positioned on a bottom side 146 of the upper knob 108 and may be configured as a second attachment interface 148 with at least one peripheral wall 152 formed around a centrally-positioned hub 150. For example, three peripheral walls 152 may be circumferentially spaced around the hub, and each of the peripheral walls 152 may have substantially the same arc length and radius. Each peripheral wall 152 can define an interior surface 154 with a second press-fit feature 156, for example an interior rim 158, that extends radially-inward and into a gap 160 between the respective peripheral wall 152 and the hub 150. The second attachment interface 148 may also include at least one second positioning feature 162 positioned on an outer surface 164 of the hub 150 and projecting into the gap 160. For example, a hub 150 can include a plurality of hub teeth 166 spaced around the outer surface 164 and extending from a base of the hub 150 to an axial end thereof 170.

In some embodiments, a second attachment interface can include at least one feature that is different than the illustrated second attachment interface. A second attachment interface can include more second positioning features or fewer second positioning features than the illustrated embodiment, and at least one second positioning feature can be different than at least one other second positioning feature. For example, at least one second positioning feature can be positioned on an interior surface of a peripheral wall, and at least one second positioning may be a ridge extending only a portion of the way between a base of the hub and its axial end.

Additionally or alternatively, some embodiments can include more than three peripheral walls, fewer than three peripheral walls, and at least one peripheral wall may be different than another peripheral wall. For example at least one peripheral wall may be larger than at least one other peripheral wall, and a peripheral wall may extend further around the hub than at least one other peripheral wall. Further, a second attachment interface can be configured with clustered peripheral walls that are not evenly spaced around the hub. At least one second press-fit feature may also be differently configured. For example, at least one second press-fit feature may be positioned on the outer surface of the hub. At least one second press-fit feature may be broken into multiple segments, and/or at least one second press-fit feature can be omitted from a peripheral wall.

As previously described, the lower-knob attachment interface 112 and the upper-knob attachment interface 116 may be manually engaged with one another in order to securely attach the upper knob 108 to the lower knob 104. In order to form this connection, the upper knob 108 can be positioned above the lower knob 104 so that the hub 150 is aligned with the central cavity 126 of the tube 124. The upper knob 104 may then be rotated into any orientation in which the inward facing ridges 138 are aligned with the spaces between adjacent hub teeth 166. Thus, in some embodiments, the number of possible orientations of the upper knob 104 relative to the lower knob 108 may be limited to a range. The total number of possible positions in the range can be a function of at least one of the total number of hub teeth 166, the size of the spaces between adjacent hub teeth 166, and the size of the inward facing ridges 138. Additionally or alternatively, the number of possible orientations of the upper knob may be dependent on at least one other factor.

Once the first and second positioning features 134, 162 are in alignment, the upper-knob attachment interface 116 may be moved downward into engagement with the lower-knob attachment interface 112. Initially, the annular lip 128 on the tube 124 may abut the interior rims 158 on the peripheral walls 152, blocking engagement of the lower-knob and upper-knob attachment interfaces 112, 116. In such an embodiment, at least one of the annular lip 128, an interior rim 158, the hub 150 and a peripheral wall 152 may be elastically deformable to allow the annular lip 128 and the interior rim 158 to move past each other. The amount of force used to accomplish this may be a function of at least one of the material used to form the lower-knob attachment interface 112, the material used to form the upper-knob attachment interface 116, the size of the annular lip 128, and the size of the interior rims 158.

Once sufficient force is applied, the hub 150 can move into the central cavity 126, with the inward facing ridges 138 sliding into interleaved engagement with the hub teeth 166, and tube 124 can be received in the gaps 160 between the peripheral walls 152 and the hub 150. After the annular lip 128 passes the interior rim 158, the plastically-deformed portion (or portions) of the lower-knob and upper-knob attachment interfaces 112, 116 may return to their original shape, thereby inhibiting disengagement of the lower-knob attachment interface 112 and the upper-knob attachment interface 116 to the upper knob 108 to the lower knob 104. While the attachment interfaces 112, 116 are engaged, the interleaved engagement of the inward facing ridges 138 and the hub teeth 166 may restrict rotation of the lower and upper knobs 104, 108 relative to each other, fixing in orientation of the upper knob 108 and linking the rotation of the lower knob 104 to the rotation of the upper knob 108. This may be useful, for example, in order to turn the lower knob 104 using the upper knob 108 when the lower knob 104 is not directly accessible by a user.

It should be appreciated that, in some embodiments, a different configuration of at least one of a lower-knob attachment interface and an upper-knob attachment interface can be implemented. For example, a lower-knob attachment interface can include at least one of a hub, a hub tooth, a peripheral wall, and an interior rim in place of or in addition to at least one of a tube, an annular lip, and an inward facing ridge. An upper-knob attachment interface can include at least one of a tube, an annular lip, and an inward ridge in place of or in addition to at least one of a hub, a hub tooth, a peripheral wall, and an interior rim. In some embodiments at least one different attachment feature may be used in addition to or in place of the first and second press-fit features. In some embodiments, for example, an upper knob may be secured to a lower know with at least one of a snap-fit feature, and adhesive, and sonic welding. In some embodiments, still other methods may be used.

In some embodiments, the first attachment interface and the second attachment interface may be interchangeable with each other. A lower-knob attachment interface can be configured as a second attachment interface including at least one of a hub, a hub tooth, a peripheral wall, and an interior rim. Similarly, an upper-knob attachment interface may be configured as a first attachment interface including at least one of a tube, an annular lip, and an inward facing ridge. Additionally or alternatively, at least one of a lower-knob attachment interface and an upper-knob attachment interface may include at least one other feature that is different than those illustrated. Similarly, at least one of the illustrated features may be omitted from at least one of a lower-knob attachment interface and an upper-knob attachment interface.

Returning to the figures, the upper knob 104 and the lower knob 108 can include features in addition to the lower-knob attachment interface 112 and the upper-knob attachment interface 116. For example, referring to FIGS. 1-2, a top face 180 of an upper knob 108 can include a turning feature 182 that can provide a way to rotate the upper knob 108, and an orientation indicator 184 that visually indicated the orientation (rotational position) of the upper knob 108. The turning feature 182 may be configured as a screw drive slot 186 for receiving a screwdriver head (of any other screw driving bit or device) that can be rotated to turn the upper knob 108. Further, the upper knob 108 can include a stop member 190 projecting downwardly from the bottom side 146 thereof. The stop member 190 may be positioned between two of the peripheral walls 152 proximate a distal edge 192 of the upper knob 108, and can be configured to limit the rotation of the upper knob 108.

In some embodiments, a turning feature can also be configured as a different type of recess or slot, or a protrusion extending from the top face and which can be gripped or engaged to rotate the upper knob. Some embodiments of an upper knob may include at least one of an additional turning mechanism and an additional orientation indicators, which may be the same or different than those illustrated. Additionally or alternatively, an upper knob can omit at least one of a turning feature and an orientation indicator.

Some embodiments of an upper knob can include a stop member with at least one of a different shape, a different size, and a different position. For example, a stop member can be positioned on at least one of the top face of the upper knob, the distal edge of the upper knob, the hub, and a peripheral wall. An upper knob can include at least one additional stop member, which can be the same or different than at least one other stop member, and an upper knob may not include any stop members. Additionally or alternatively, some embodiments can include a stop member that is integrally formed with a peripheral wall, and a stop member can include an interior rim or any other feature configured as a second press-fit feature.

Figure 3:
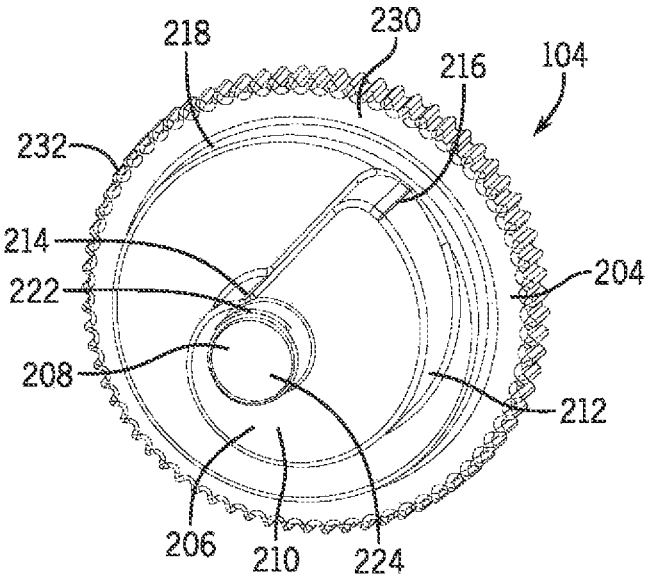
FIG. 3 is a perspective view of a lower knob of FIG. 1.

Referring now to FIGS. 1 and 3, the bottom side 204 of the lower knob 104 can include a biasing feature 206 and a shaft 208 extending downwardly from the biasing feature 206. The biasing feature 200 may be configured as a cam 210 with a curved outer surface 212 that spirals outward from an innermost end 214 proximate the shaft 208 and an outermost end 216 proximate a distal edge 218 of the lower knob 104. A shaft press-fit feature 222 can be positioned proximate an axial end 223 of the shaft 208 and may form an annular lip around at least a portion of the circumference of the shaft 208. Further, a grooved ring 230 may be formed around the distal edge 218 of the lower knob 104 and can include a plurality of grooves 232 facing radially outward and away from the tube 124. While the grooved ring 230 may be formed integrally with the lower knob 104 in some embodiments, it may be configured as a separate component that is secured to a lower knob in other embodiments.

It should be appreciated that embodiments of a lower knob can include at least one of a cam that is differently shaped, sized and/or positioned, and biasing feature other than a cam, such as a lever, a screw gear, a screw driver, or any other biasing feature. A cam can have an outer surface that is not curved, and an outer surface can have at least one of an innermost end and an outermost end that is closer to or farther from the center of the lower knob. Additionally or alternatively, a shaft may be configured to extend from the bottom side of the lower knob rather than extending from the biasing feature. The shaft can include at least one additional shaft press-fit feature that can be different or the same as at least one other shaft press-fit feature. For example, a shaft press-fit feature may extend around the shaft in a continuous annular lip. Further, some embodiments of a shaft can be formed without a shaft press-fit feature.

Figure 4:
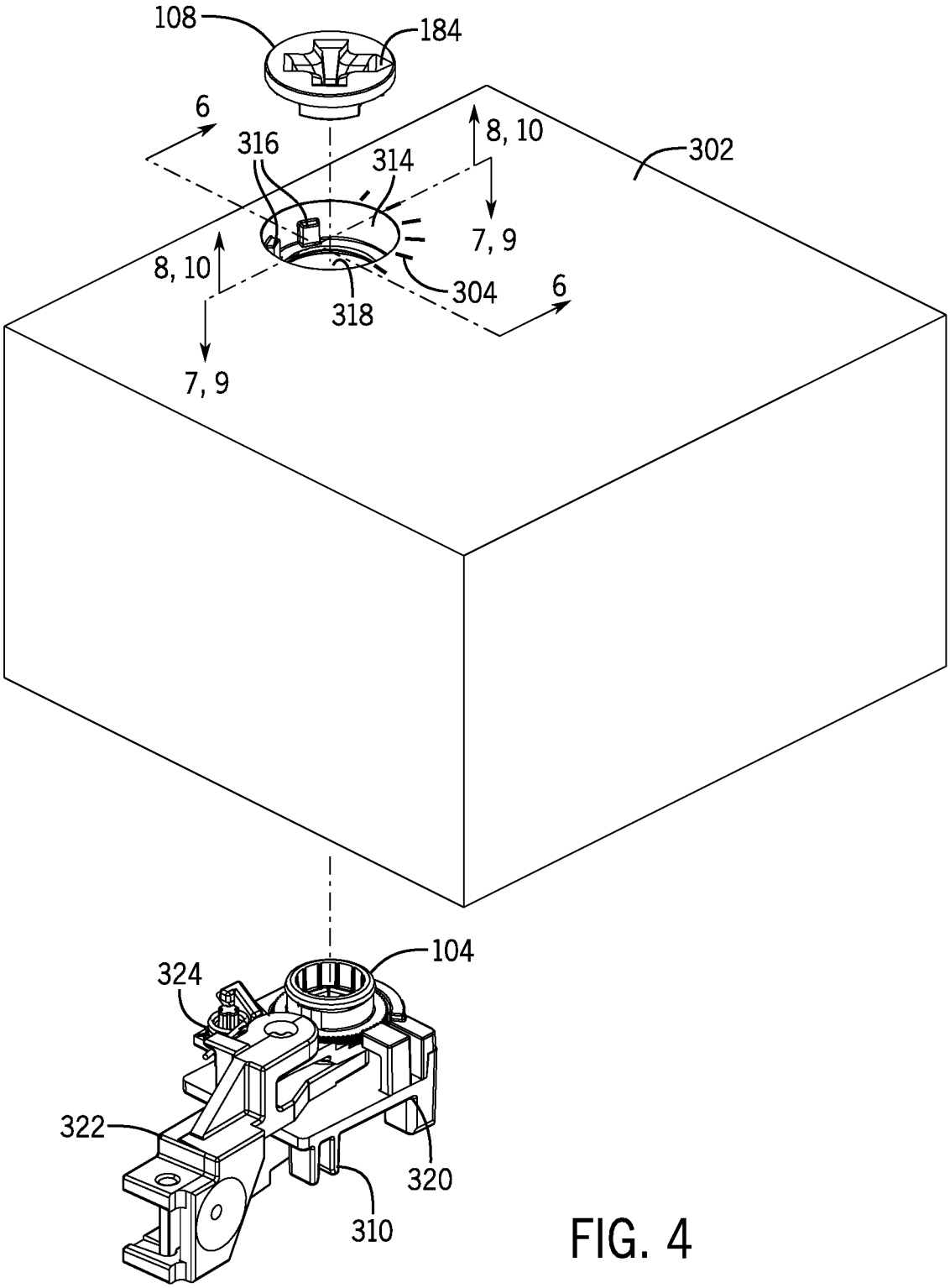
FIG. 4 is an exploded perspective view of the split calibration knob of FIG. 1, including a cover and a calibration holder according to some embodiments of the present disclosure.

As previously discussed, embodiments of a split calibration knob can be used with an adjustable device using a cover having a predetermined scale. For example, as illustrated in FIG. 4, a split calibration knob including the upper knob 108 and lower knob 104 of FIGS. 1-3 can be used with an adjustable device (not shown) that has a cover 302 displaying a predetermined scale 304, and includes a calibration assembly 310 configured to be positioned inside the cover 302 and support the lower knob 104. The cover 302 can include a cover recess 314 that may be positioned proximate the predetermined scale 304 and dimensioned to receive the upper knob 108. At least one cover stop 316 may be positioned within the cover recess 314, and each cover stop 316 being configured to engage the stop member 190 to restrict the rotational movement of the upper knob 104. Further, a cover opening 318 sized to receive the tube 124 may be formed through the cover 302 in the center of the cover recess 314.

Figure 5:
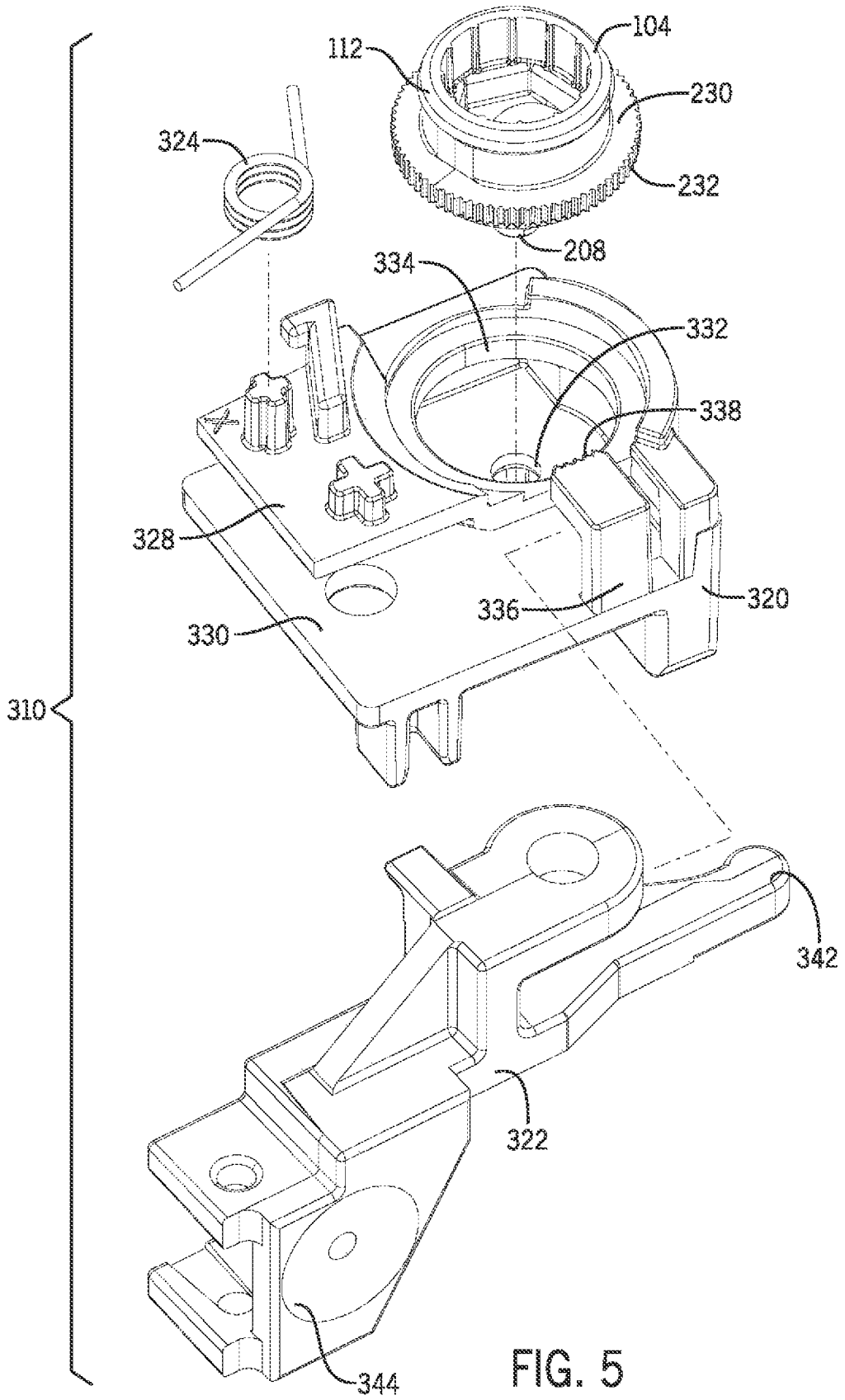
FIG. 5 is an exploded perspective view of a lower knob and calibration holder of FIG. 4.
Figure 6:
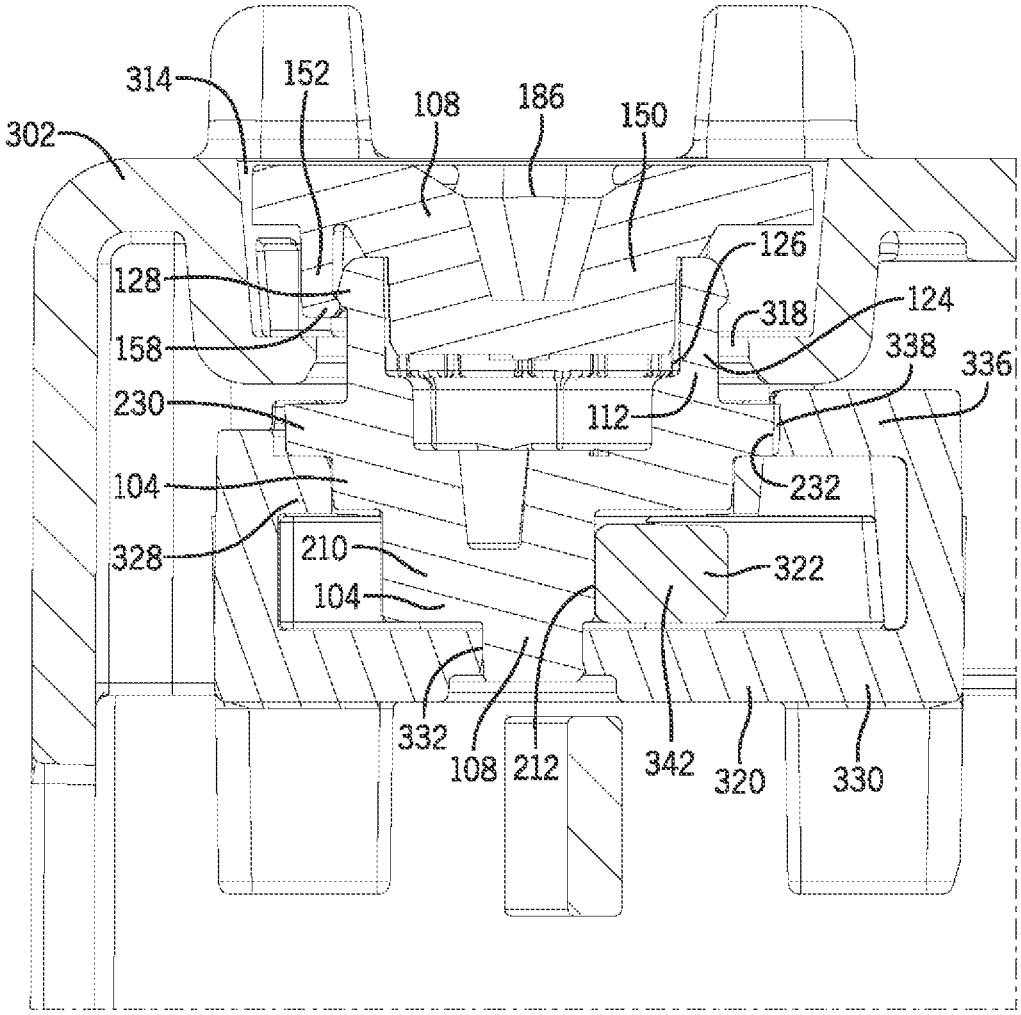
FIG. 6 is a side cross-sectional view 6-6 of the split calibration knob, cover, and calibration holder of FIG. 4 in an assembled configuration.

In some embodiments, an adjustable device can be configured to use a different cover. For example, a cover may be formed with a cover recess that is deeper or shallower than the illustrated embodiment. A cover can also be formed without a cover recess and, additionally or alternatively, at least one stop member may be formed on the face of the cover rather than in the cover recess. Although the illustrated cover includes two cover stops, some embodiments can includes more than two cover stops or fewer than two cover stops. At least one cover stop may be configured with at least one of a different shape, a different size, and a different position that the illustrated cover stops. Additionally or alternatively, a cover can include a predetermined scale that is the same or different than the illustrated embodiment. For example, a predetermined scale may extend a different distance around the cover recess, and a predetermined scale may be positioned in a different location on the cover. In some embodiments, a predetermined scale may be differently shaped and can have at least one marking that is different than at least one other marking Referring to FIG. 5, the calibration assembly 310 can include a base 320 configured to rotatably receive the lower knob 104, a biasing element 324, and a lever 322 configured to be biased into engagement with the lower knob 104 by the biasing element 324. The base 320 may include an upper plate 328 positioned in a spaced apart relationship with a bottom plate 330, and can be configured to be received by at least one of the cover 302 and a portion of the adjustable device. A shaft opening 332 that is sized to receive the shaft 208 can be formed through the bottom plate 330 and may be concentric with a knob hole 334 formed through the top plate 328. As shown by FIG. 6, the lower knob 104 may be inserted into the knob hole 334 so that the shaft 208 engages the shaft opening 332 and the lower knob 104 is rotatably received by the base 320. While the shaft 208 is received in the shaft opening 332, the shaft press-fit feature can be configured to retain the lower knob 104 on the base 320, either permanently or temporarily. This may be useful, for example, before the cover 302 is secured to the adjustable device. In some embodiments, a different attachment feature may be used in addition to or in place of the shaft press-fit feature. For example, a lower knob may be secured to a base with at least one of a snap-fit feature, and adhesive, and sonic welding. In some embodiments, still other methods may be used.

The base may also include feedback arm 336 that has at least one feedback tooth 338 and extends towards the middle of the knob hole 334. When the lower knob 104 is received in the knob hole 334, the feedback teeth 338 may be configured to engage the grooves 232 on the grooved ring 230. In such an embodiment, the engagement of the feedback teeth 338 and the grooves 232 may resist, but not prevent, rotation of the lower knob 104 in order to provide tactile feedback as the lower knob 104 rotates. For example, the feedback teeth 338 and the grooves 232 may provide initial resistance against rotation of the lower knob 104, but can then push the lower knob 104 once it is rotated far enough, thereby causing it to jump or "pop" into the next rotational position.

In some embodiments, a calibration assembly can include a base that omits at least one of the top plate and the bottom plate. For example, a base may include a bottom plate with a shaft opening without a top plate. Further, a base may be a substantially solid body with a shaft opening positioned at the bottom of a knob hole. Additionally or alternatively, the feedback teeth 338 can be positioned on a different portion or the base and may be configured to engage a different portion of the upper knob or the lower knob. For example, the feedback teeth may be configured to engage grooves formed of the tube of the lower knob. In some embodiments feedback teeth can be provided by the cover and may be configured to engage at least one of the upper knob and the lower knob. For example at least one feedback tooth on the cover may be configured to engage the groves of a grooved ring formed on (or coupled to) the upper knob. In still further embodiments, at least one of the upper knob and the lower knob can include at least one feedback tooth configured to engage groves formed on at least one of the cover, the base, and any other portion of the adjustable device.

Figure 8:
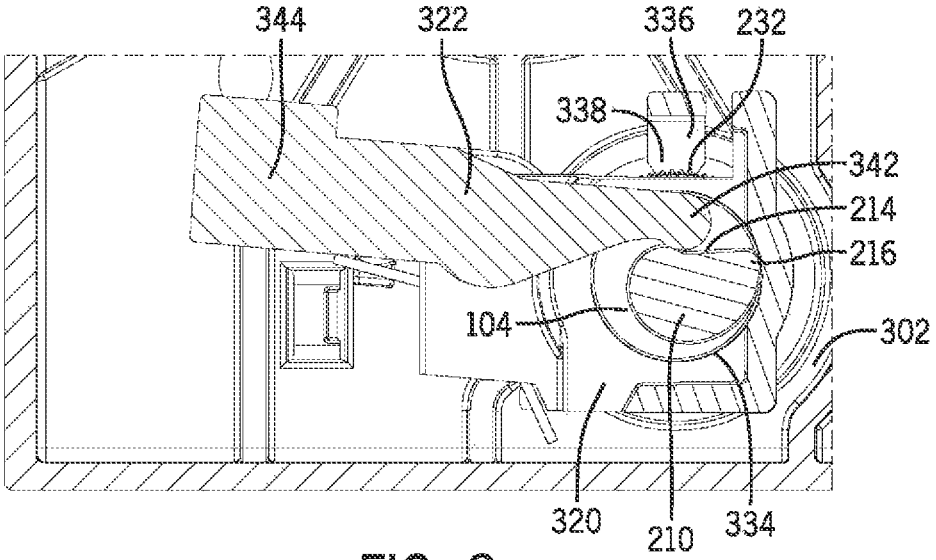
FIG. 8 is a bottom-up cross sectional view 8-8 of the split calibration knob, cover, and calibration holder of FIG. 7 in the first position.

With continued reference to the figures, the lever 322 may be rotatably received by the base 320 at a position offset from the shaft opening 332 and the knob hole 334, and can have a knob end 342 that extends towards the knob opening 332 between the top plate 328 and the bottom plate 330. As illustrated in FIGS. 6 and 8, the biasing element 324 may bias the lever 322 so that the knob end 342 engages the outer surface 212 of the cam 210. Thus, in some embodiments, the position of the lever 322 can be adjusted by rotating the lower knob 104 so that the cam 210 pushes the knob end 342 outward, causing the lever 322 to rotate. An adjusting end 344 of the lever 322 opposite the knob end 342 may be configured to interact with the adjustable device to change the device setting based on the position of the lever 322.

According to some methods of using a split calibration knob 100, the lower knob 104 can be rotated to a set point before the upper knob 108 is attached to the lower knob 104. For example, the set point could be one associated with a minimum deflection of the lever 322, where the knob end 342 is in contact with an innermost end 214 of the outer surface 212 of the cam (see, e.g., FIGS. 6 and 8). The cover 302 may then be placed over the calibration assembly 310 and lower knob 104, and attached to the adjustable device. In some embodiments, a portion of the cover 302 at the bottom of the cover recess 314 may be configure to restrict vertical movement of the lower knob, thereby retaining the shaft 208 in the shaft opening 332 and the lower knob 104 in the knob hole 334. The upper knob 108 may then be inserted into the cover recess 314 to engage the lower knob 104 (which extends through the cover opening 318) in an orientation where the orientation indicator 184 points to the appropriate portion of the predetermined scale 304. Once the upper knob 108 is attached to calibrate the adjustable device, the range of rotational movement of the upper knob 108 may be limited by the at least one cover stop 316. Because the position of the lever 322 may be controlled by rotating the attached upper knob 108, the range of possible values of the device setting of the adjustable device can be a function of the range of rotation permitted by the cover stops 316.

Figure 7:
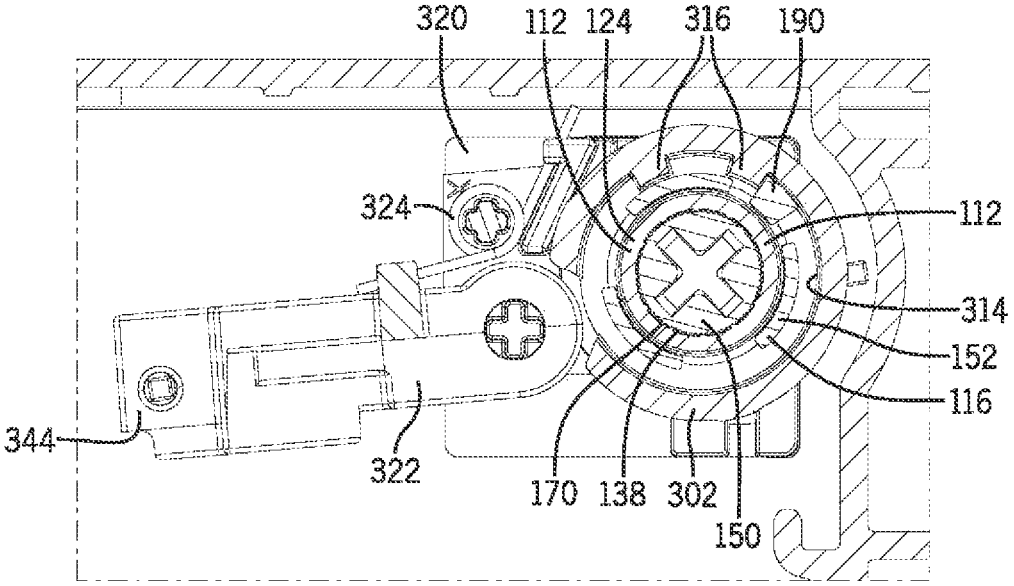
FIG. 7 is a top-down cross sectional view 7-7 of the split calibration knob, cover, and calibration holder of FIG. 6 in a first position.
Figure 9:
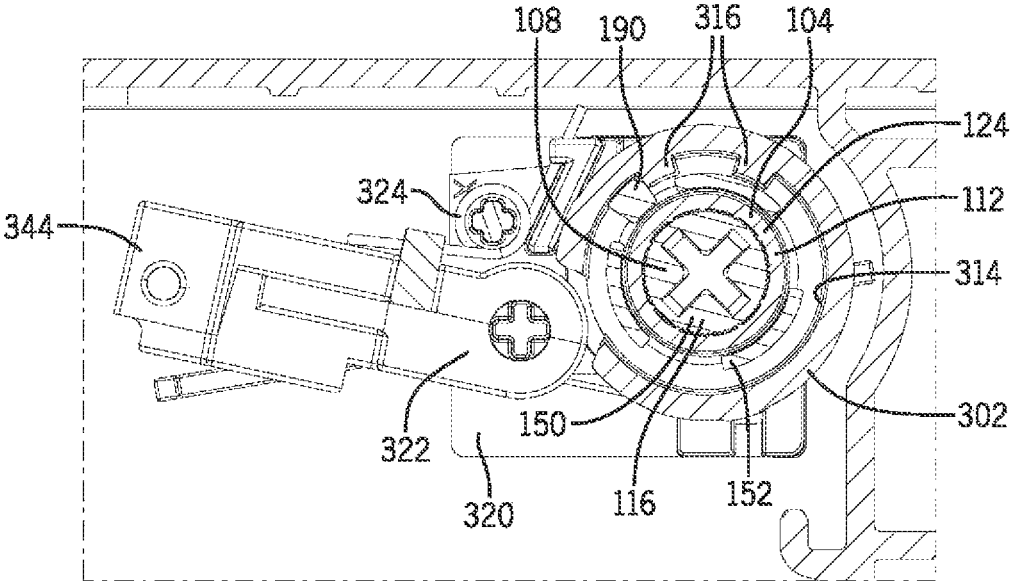
FIG. 9 is a top-down cross sectional view 9-9 of the split calibration knob, cover, and calibration holder of FIG. 8 in a second position.
Figure 10:
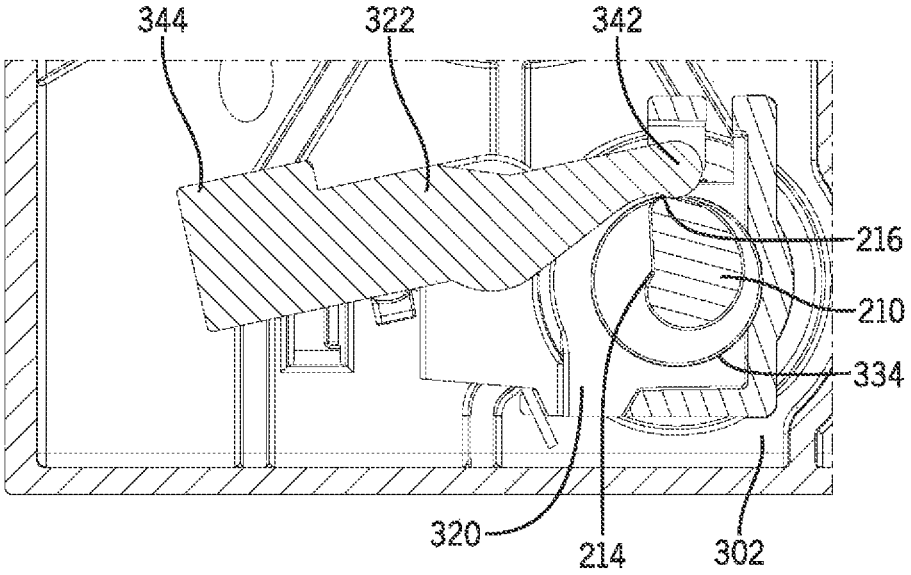
FIG. 10 is a bottom-up cross sectional view 10-10 of the split calibration knob, cover, and calibration holder of FIG. 9 in the second position.

In an embodiment in which set point is associated with the minimum deflection of the lever 322, the stop member 190 of the upper knob 108 can be configured to abut, or be adjacent to, one of the cover stops 316 (e.g., as illustrated in FIG. 7). The upper knob 108 may be rotated to a second rotational limit in which the stop member abuts another cover stop 316 or, when only one cover stop is provided, the opposite side of the cover stop. As illustrated in FIGS. 9 and 10, the second rotational limit of the upper knob 108 may be associated with a maximum deflection of the lever 322 where the knob end 342 is in contact with an outermost end 216 of the outer surface 212 of the cam. While the upper knob 108 be intended for permanent attachment to the lower knob 104 in some embodiments, it may be removable in order to recalibrate or repair the adjustable device. In some embodiments, a vacuum suction system or device may be used to remove the upper knob 108 from the lower knob 104. Additionally or alternatively, portions of the upper knob 108 may be cut, drilled, or otherwise altered to decouple the upper knob 108 from the lower knob 104.

It should be appreciated that some embodiments can have a set point in which the lever is deflected at least one of a minimum distance from the axis of rotation of the lower knob, a maximum distance from the axis of rotation of the lower knob, a distance that is between the minimum and maximum deflections of the lever. The set point can be standardized for a specific type of adjustable device, and a set point may be customized for each individual adjustable device. Additionally or alternatively, at least one of the predetermined scale and the orientation indicator can have at least one of a different shape, size, orientation, and position in some embodiments.

Figure 11:
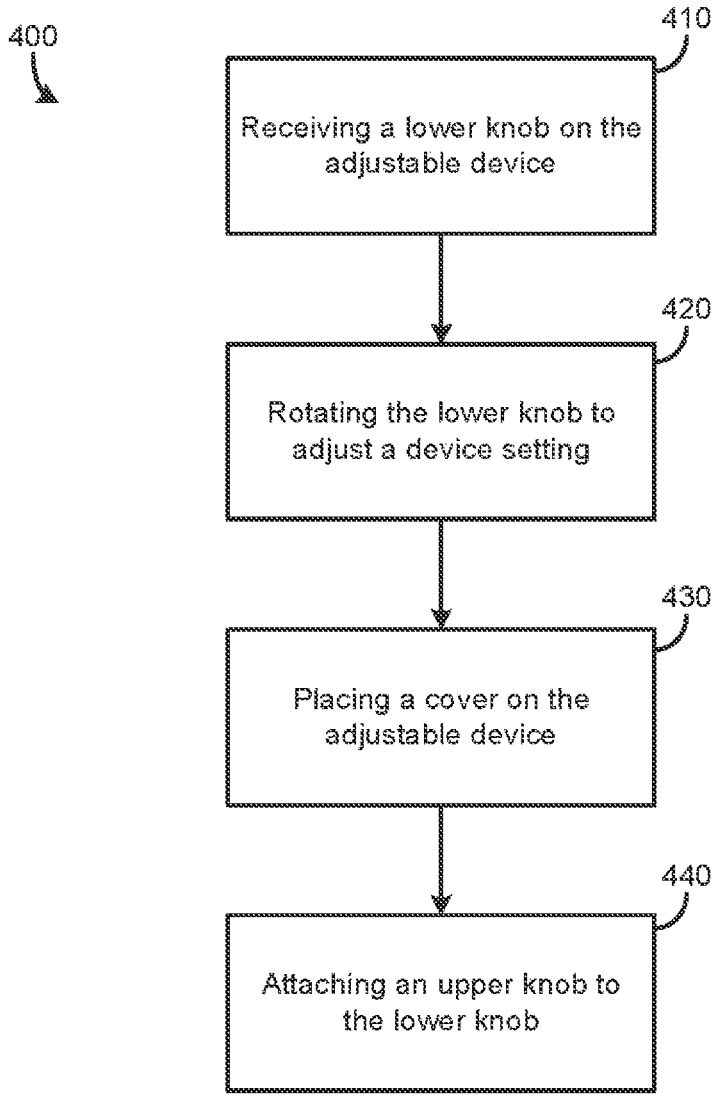
FIG. 11 is a process diagram illustrating a method for using a split calibration knob, according to some embodiments of the present disclosure.

FIG. 11 illustrates embodiments of methods for use with a split calibration knob. The method 400 shown in FIG. 11 may be used in conjunction with any of the systems or devices shown in the FIGS. 1-10, among other embodiments. In various embodiments, some of the method elements shown may be performed concurrently, in a different order than shown, or may be omitted. Additional method elements may also be performed as desired.

As shown by method 400, the lower knob 108 may be received in the calibration assembly 310 at step 410. In some embodiments, this may include inserting the lower knob into a knob hole 334 of a base 320 so that a shaft 208 on the lower knob 108 is received in a shaft opening 332. With a lever 322 and a biasing element 324 also received on the base 320, the lower knob 104 can be rotated to adjust the position of the lever 322 at step 420, thereby adjusting the device setting of the adjustable device. This may include rotating the upper knob 104 to a set point in which the lever 322 is deflected at least one of a minimum distance from the axis of rotation of the lower knob 108, a maximum distance from the axis of rotation of the lower knob 108, a distance that is between the minimum and maximum deflections of the lever 322.

At step 430, the cover 302 may then be positioned to over the calibration assembly 310 and the lower knob 108. In some embodiments, this may include retaining, with the cover 302, the lower knob 104 on the calibration assembly 310. With the cover 302 in place, the upper knob 108 can be coupled to the lower knob 104 to calibrate the adjustable device (step 440). This might include steps for aligning an upper-knob attachment interface 116 with a lower-knob attachment interface 112, and moving the upper-knob attachment interface 116 into engagement with the lower-knob attachment interface 112. Additionally or alternatively, the upper knob 108 may be oriented so that it is secured to the lower knob 104 so that an orientation indicator 184 points to a portion of a predetermined and prepositioned scale 304 that is associated with the position of the lower knob 104 and the lever 322.

In the preceding specification, various embodiments have been described with reference to the accompanying drawings. It will, however, be evident that various modifications and changes may be made thereto, and additional embodiments may be implemented, without departing from the broader scope of the invention as set forth in the claims that follow. The specification and drawings are accordingly to be regarded in an illustrative rather than restrictive sense.

What is claimed is:

1. A calibration system for an adjustable device, the calibration system comprising:

a calibration assembly comprising a lever rotatably received by a base, the lever configured to adjust a device setting of the adjustable device based on a position of the lever; and a split calibration knob configured to be secured to the adjustable device, the split calibration knob comprising:

a lower knob configured to be rotatably received by the base and comprising a biasing member configured to adjust the position of the lever when the lower knob is rotated; and an upper knob configured to be secured to the lower knob in an orientation that is independent of the position of the lower knob.

2. The calibration system of claim 1, wherein the orientation of the upper knob relative to the lower knob is fixed so that the lower knob can be rotated by rotating the upper knob.

3. The calibration system of claim 1, wherein the upper knob comprises an orientation indicator configured to substantially align with a position on a scale on a cover of the adjustable device.

4. The calibration system of claim 3, wherein the upper knob comprises a stop member configured to engage a cover stop formed on the cover.

5. The calibration system of claim 4, wherein the cover stop is configured to limit rotational motion of the upper knob to a range corresponding to a range of the scale.

6. The calibration system of claim 1, wherein the upper knob secured to the lower knob is configured to restrict rotation of the upper knob relative to the lower knob.

7. The calibration system of claim 1, wherein the biasing member comprises at least one of a second lever, a screw gear, and a screw driver.

8. The calibration system of claim 1, further comprising a shaft extending from the lower knob, the shaft configured to be received by the base.

9. The calibration system of claim 8, wherein the biasing member comprises a cam.

10. The calibration system of claim 9, wherein the cam comprises a curved outer surface which spirals outward from a first end proximate the shaft to a second end proximate a distal edge of the lower knob.

11. The calibration system of claim 8, wherein the shaft includes a press-fit member forming an annular lip around at least a portion of a circumference of the shaft.

12. The system of claim 11, wherein the press-fit member is configured to engage the base such that the lower knob is retained on the base.

13. A method of calibrating an adjustable device, the method comprising:

receiving a lower knob on a base of a calibration assembly;

rotating the lower knob to engage a lever of the calibration assembly, a lever position corresponding to an adjustable device setting of the adjustable device;

placing a cover over the lower knob and calibration assembly; and attaching an upper knob to the lower knob, via a recess in the cover, in an orientation that is independent of the position of the lower knob.

14. The method of claim 13, wherein rotating the lower knob comprises rotating the lower knob to a set point.

15. The method of claim 13, wherein attaching the upper knob comprises positioning the upper knob such that an orientation indicator substantially aligns with a scale on the cover.

16. The method of claim 15, further comprising limiting a rotation of the upper knob, via a cover stop, to a corresponding range of the scale.

17. The method of claim 13, wherein rotating the lower knob causes a biasing member to engage the lever of the calibration assembly.

18. The method of claim 13, wherein receiving the lower knob on the base comprises the base engaging a press-fit member on a shaft of the lower knob.

19. The method of claim 13, further comprising restricting vertical movement of the lower knob via a portion of the cover defining the recess in the cover.

20. The method of claim 13, wherein attaching the upper knob to the lower knob comprises attaching the upper knob to the lower knob in an orientation that corresponds to the adjustable device setting.

* * * * *